US009324297B2

(12) United States Patent
Kasegawa et al.

(10) Patent No.: US 9,324,297 B2
(45) Date of Patent: Apr. 26, 2016

(54) IMAGE DISPLAY UNIT, METHOD OF DRIVING IMAGE DISPLAY UNIT, SIGNAL GENERATOR, SIGNAL GENERATION PROGRAM, AND SIGNAL GENERATION METHOD

(71) Applicant: Sony Corporation, Tokyo (JP)

(72) Inventors: Ryo Kasegawa, Kanagawa (JP); Akihito Nishiike, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 391 days.

(21) Appl. No.: 14/037,466

(22) Filed: Sep. 26, 2013

(65) Prior Publication Data

US 2014/0111409 A1 Apr. 24, 2014

(30) Foreign Application Priority Data

Oct. 3, 2012 (JP) ..... 2012-220927

(51) Int. Cl.
*G09G 5/02* (2006.01)

(52) U.S. Cl.
CPC ..... *G09G 5/02* (2013.01)

(58) Field of Classification Search
CPC ..... G09G 3/3607
USPC ..... 345/83, 84, 107, 690, 694
See application file for complete search history.

(56) References Cited

FOREIGN PATENT DOCUMENTS

JP 4120674 7/2008

*Primary Examiner* — Calvin C Ma
(74) *Attorney, Agent, or Firm* — Hazuki International, LLC

(57) ABSTRACT

An image display unit, includes: an image display section having pixels each including red, green, blue, and white pixels; and a signal generating section configured to generate red, green, blue, and white sub-pixel signals, the signal generating section being configured to determine values of the red, green, and blue sub-pixel signals $R_{cvt}$, $G_{cvt}$, and $B_{cvt}$, based on a first matrix and a second matrix, with use of a coefficient 'Purity', an additive-color-mixture matrix, and a purity coefficient 'Ψ', and being configured to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-, green-, and blue-display image signal $R_{nL}$, $G_{nL}$, and $B_{nL}$ that are linearized and normalized and are provided for each of the pixels.

8 Claims, 6 Drawing Sheets

IMAGE DISPLAY UNIT, METHOD OF DRIVING IMAGE DISPLAY UNIT, SIGNAL GENERATOR, SIGNAL GENERATION PROGRAM, AND SIGNAL GENERATION METHOD

CROSS REFERENCE TO RELATED APPLICATIONS

This application claims the benefit of priority under 35 U.S.C. §119 from Japanese Priority Patent Application JP 2012-220927 filed on Oct. 3, 2012, the entire contents of each which is incorporated herein by reference.

BACKGROUND

The present disclosure relates to an image display unit and to a method of driving an image display unit, as well as to a signal generator, to a signal generation program, and to a signal generation method.

In recent years, in image display units for color image display, to achieve higher luminance and other improvements, a technology has drawn attention that adopts a configuration in which, for example, a white sub-pixel for white display in addition to three sub-pixels including a red sub-pixel for red display, a green sub-pixel for green display, and a blue sub-pixel for blue display.

For example, Japanese Patent No. 4120674 discloses an image display unit that includes: a liquid crystal panel that is provided with display pixels including a sub-pixel having a transparent or a white region in addition to sub-pixels for color image display; an illuminator for illuminating the liquid crystal panel; and a display image conversion circuit that determines an image signal corresponding to each sub-pixel and a control signal to adjust the luminance of light emitted out of the illuminator on the basis of inputted RGB image signals.

SUMMARY

In the technology disclosed in Japanese Patent No. 4120674, based on the premise that the luminance of light emitted out of the illuminator is controllable, an image signal corresponding to each sub-pixel is determined based on the inputted RGB image signals. Therefore, such a technology is not suitable for control of a reflective image display unit that performs display by reflecting external light, an image display unit having an illuminator in which the intensity of light to be emitted out is fixed, and the like.

It is desirable to provide an image display unit and a method of driving an image display unit, as well as a signal generator, a signal generation program, and a signal generation method, that are capable of raising the luminance assuredly even in the case where display is performed by reflecting external light, etc.

According to an embodiment of the present disclosure, there is provided an image display unit, including:

an image display section having pixels arranged two-dimensionally in a matrix pattern, the pixels each including a red sub-pixel, a green sub-pixel, a blue sub-pixel, and a white sub-pixel; and a signal generating section configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generating section being configured to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and being configured to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

According to an embodiment of the present disclosure, there is provided a method of driving an image display unit with an image display section and a signal generating section, the image display section having pixels arranged two-dimensionally in a matrix pattern, the pixels each including a red sub-pixel, a green sub-pixel, a blue sub-pixel, and a white sub-pixel, and the signal generating section being configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the method including:

allowing the signal generating section to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and allowing the signal generating section to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix sed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'ΨF' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

According to an embodiment of the present embodiment, there is provided a non-transitory tangible recording medium having a computer-readable program embodied therein, the computer-readable program allowing, when executed by an signal generator, the signal generator to perform data processing, the signal generator being configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the data processing including:

allowing the signal generator to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and allowing the signal generator to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

According to an embodiment of the present disclosure, there is provided a signal generator including a signal generating section configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generating section being configured to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and being configured to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

According to an embodiment of the present embodiment, there is provided a signal generation method generating a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generation method including:

determining values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ'; and employing a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{in}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

In the image display unit and the method of driving the image display unit, as well as the signal generator, the signal generation program, and the signal generation method according to the above-described respective embodiments of the present disclosure, images are displayed in a state where the white sub-pixels are effectively used. Therefore, it is possible to assuredly raise the luminance of images to be displayed.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the present disclosure, and are incorporated in and constitute a part of this specification. The drawings illustrate embodiments and, together with the specification, serve to explain the principles of the present technology.

DETAILED DESCRIPTION

Figure 1:
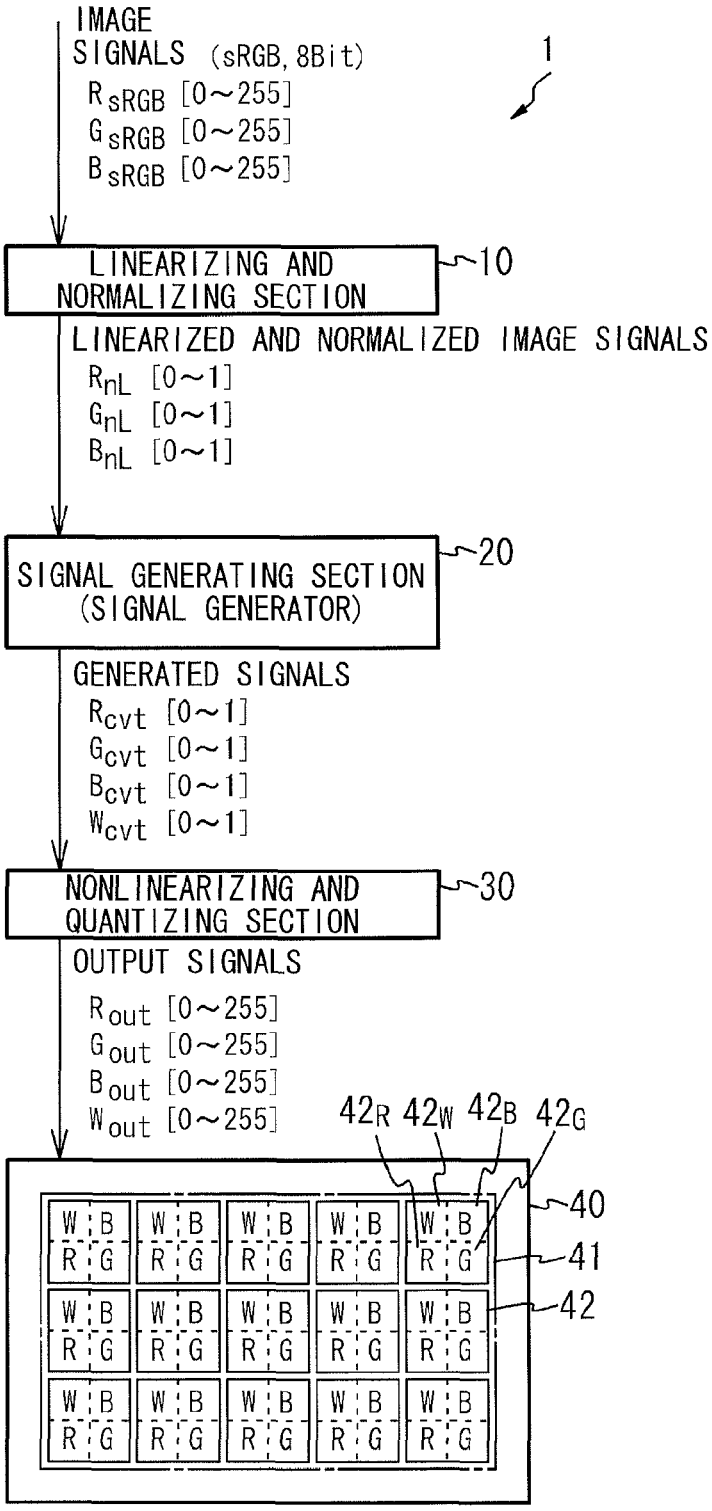
FIG. 1 is a conceptual diagram of an image display unit according to a first embodiment of the present disclosure.

Hereinafter, some embodiments of the present disclosure are described with reference to the drawings. The present disclosure is not limited to the embodiments, and various numerical values and materials in the embodiments are illustrated as mere examples. In the following descriptions, the same component parts or component parts having the same functions are denoted with the same reference numerals, and descriptions thereof are omitted. It is to be noted that the descriptions are provided in the order given below.

1. General description of the image display unit and the method of driving the image display unit, as well as the signal generator, the signal generation program, and the signal generation method according to the respective embodiments of the present disclosure 2. First embodiment and others

[General Description of the Image Display Unit and the Method of Driving the Image Display Unit, as Well as the Signal Generator, the Signal Generation Program, and the Signal Generation Method According to the Respective Embodiments of the Present Disclosure]

In some embodiments of the present disclosure, a configuration and a scheme of an image display section are not specifically limited. For example, the image display section may be better suited for displaying moving images, or may be better suited for displaying still images. Further, the image display section may be of a reflective type or of a transmissive type. For a reflective image display section, for example, a well-known display member such as a reflective liquid crystal display panel and an electronic paper may be used. Alternatively, for a transmissive image display section, a well-known display member such as a transmissive liquid crystal display panel may be also used. It is to be noted that the transmissive image display section may encompass a semi-transmissive image display section that has features of both the transmissive type and the reflective type.

As pixel values, it is possible to exemplify some image display resolutions such as VGA (640, 480), S-VGA (800, 600), XGA (1024, 768), APRC (1152, 900), S-XGA (1280, 1024), U-XGA (1600, 1200), HD-TV (1920, 1080), Q-XGA (2048, 1536), as well as (1920, 1035), (720, 480), and (1280, 960), although the pixel values are not limited to these values.

In the embodiments of the present disclosure, a value of a purity coefficient 'Ψ' varies to approach a value '$TH_1$' with an increase in a value of the coefficient 'Purity' and varies to approach a value '1' with a decrease in the value of the coefficient 'Purity'. In this case, a configuration in which the purity coefficient 'Ψ' is obtained using an expression such as $\Psi=(TH_1-1)\times Purity+1$ may be preferable in terms of reduction in burden on an arithmetical operation.

The values of the above-described brightness $W_{R+G+B_max}$ and $W_{W_max}$ is obtainable on the basis of a structure of the image display section, or is measurable by operating the image display section.

A signal generating section and a signal generator that are used in the embodiments of the present disclosure may be configured of, for example, an arithmetic circuit and a memory device. The signal generating section and the signal generator may be configured using well-known circuit devices and the like. The same is applicable to a linearizing and normalizing section and a nonlinearizing and quantizing section to be hereinafter described that are shown in FIG. 1.

The signal generating section and the signal generator may be configured to operate on the basis of a physical wiring connection in hardware, or may be configured to operate on the basis of programs, for example.

Various conditions described in the present specification are also satisfied in a case where the conditions are met substantially in addition to a case where they are met stringently. For example, "red" is considered to be adequate in satisfying the condition thereof if it is recognized as red virtually. Similarly, "green" is considered to be adequate in satisfying the condition thereof if it is recognized as green virtually. The same is applicable to "blue" and "white". Further, the same is applicable to a value of $TH_1$ that is a ratio given by $W_{R+G+B_max}/(W_{R+G+B_max}+W_{W_max})$ described above. Any presence of various variations arising in design or manufacturing may be permissible.

First Embodiment

A first embodiment relates to an image display unit and to a method of driving an image display unit, as well as to a signal generator, to a signal generation program, and a signal generation method according to the embodiments of the present disclosure.

As a matter of convenience for explanation, it is assumed that image signals to be input externally may be, for example, eight-bit signals in conformity with sRGB standard ($\gamma$=2.4), and an image display section displays images depending on signals in conformity with sRGB standard. Among the image signals to be input externally, an image signal for red display (a red-display image signal), an image signal for green display (a green-display image signal), and an image signal for blue display (a blue-display image signal) are represented by reference signs $R_{sRGB}$, $G_{sRGB}$, and $B_{sRGB}$, respectively. The image signals ($R_{sRGB}$, $G_{sRGB}$, $B_{sRGB}$) may take a value between 0 and 255 both inclusive depending on the luminance of an image to be displayed. In this example, the description is provided assuming that a value [0] corresponds to the minimum luminance, and a value [255] corresponds to the maximum luminance.

FIG. 1 is a conceptual diagram of an image display unit according to the first embodiment of the present disclosure.

The image display unit 1 according to the first embodiment of the present disclosure includes: an image display section 40 in which pixels 42 configured of red sub-pixels $\mathbf{42}_R$, green sub-pixels $\mathbf{42}_G$, blue sub-pixels $\mathbf{42}_B$, and white sub-pixels $\mathbf{42}_W$ are arranged two-dimensionally in a matrix pattern; and a signal generating section (signal generator) 20 that is configured to generate a signal for the red sub-pixel (a red sub-pixel signal), a signal for the green sub-pixel (a green sub-pixel signal), a signal for the blue sub-pixel (a blue sub-pixel signal), and a signal for the white sub-pixel (a white sub-pixel signal) based on the image signal for red display, the image signal for green display, and the image signal for blue display that are provided in accordance with an image to be displayed. It is to be noted that, in the image display section 40, a display region where the pixels 42 are arranged two-dimensionally in a matrix pattern is denoted with the reference numeral 41.

Further, the image display unit 1 also includes: a linearizing and normalizing section 10 that allows the image signals ($R_{sRGB}$, $G_{sRGB}$, $B_{sRGB}$) to be input externally to become linearized and normalized signals; and a nonlinearizing and quantizing section 30 that allows later-described signals ($R_{cvt}$, $G_{cvt}$, $B_{cvt}$, $W_{cvt}$) to become eight-bit output signals in conformity with sRGB standard.

The image display section 40 may be configured of, for example, an electronic paper or a reflective liquid crystal display panel. In other words, the image display section 40 is of a reflective type that displays images by varying the reflectivity of external light incoming into the image display section 40. It is to be noted that the image display section 40 may be configured as a transmissive type as well (for example, a configuration combining a transmissive liquid crystal display panel with a backlight in which the intensity of light to be emitted out is fixed).

The red sub-pixel $42_R$ may have, for example, a structure in which a color filter that transmits a red light therethrough and a reflective region capable of controlling a degree of reflection of light are laminated. The red sub-pixel $42_R$ performs red display by controlling the reflectivity of incoming external light. Similarly, the green sub-pixel $42_G$ may have, for example, a structure in which a color filter that transmits green light therethrough and a reflective region are laminated, and the blue sub-pixel $42_B$ may have, for example, a structure in which a color filter that transmits blue light therethrough and a reflective region are laminated. The white sub-pixel $42_W$ may have, for example, a structure in which a filter that transmits incoming external light as it is therethrough and a reflective region are laminated.

For the sake of easier understanding, description is provided on the improvement of the image luminance in a manner of adding the white sub-pixel $42_W$. First, a case where the white sub-pixel $42_W$ is not provided is described.

Figure 2:
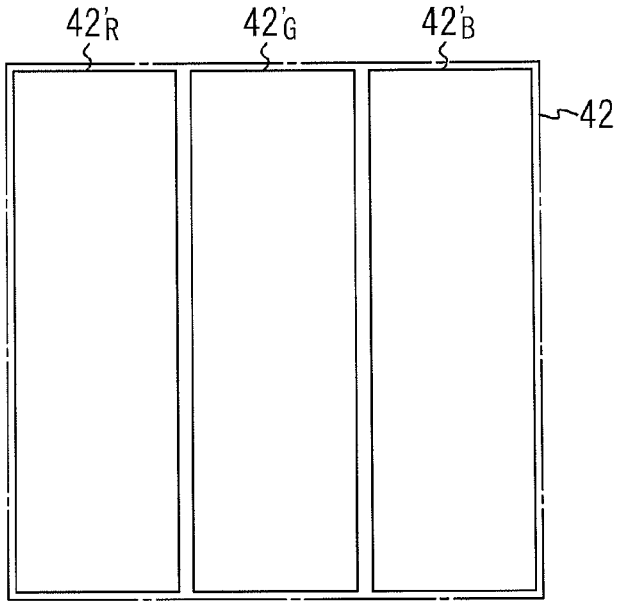
FIG. 2 is a schematic plan view for explaining the brightness in a case where white is displayed at the maximum designed luminance assuming that a pixel is configured of three sub-pixels including a red sub-pixel, a green sub-pixel, and a blue sub-pixel.

FIG. 2 is a schematic plan view for explaining the brightness in a case where white is displayed at the maximum designed luminance assuming that a pixel is configured of three sub-pixels including a red sub-pixel, a green sub-pixel, and a blue sub-pixel.

For convenience of explanation, an area occupied by a single pixel 42 is denoted by a reference sign $S_{PX}$, and a red sub-pixel, a green sub-pixel, and a blue sub-pixel are denoted by reference numerals $42_R'$, $42_G'$, and $42_B'$, respectively. Further, an area occupied by each of the sub-pixels is assumed to be about $S_{PX}/3$.

The red sub-pixel $42_R'$, the green sub-pixel $42_G'$, and the blue sub-pixel $42_B'$ perform white display using additive color mixture (more specifically, juxtaposition additive color mixture).

Here, for convenience of explanation, it is assumed that external light in white with a constant intensity comes into the pixel 2, and when the red sub-pixel $42_R'$ reaches the maximum designed luminance, a state where about half of red component in the external light is reflected is achieved, and, when the green sub-pixel $42_G'$ reaches the maximum designed luminance, a state where about half of green component in the external light is reflected is achieved, and when the blue sub-pixel $42_B'$ reaches the maximum designed luminance, a state where about half of blue component in the external light is reflected is achieved. The same is applicable to the description with reference to FIG. 3 to be given hereinafter.

If the brightness of external light incoming into the pixel 42 is "1", the maximum designed luminance for white display using the additive color mixture of the red sub-pixel $42_R'$, the green sub-pixel $42_G'$, and the blue sub-pixel $42_B'$, that is, the brightness of outgoing light becomes about "½".

Next, a case where the white sub-pixel $42_W$ is provided is described.

Figure 3:
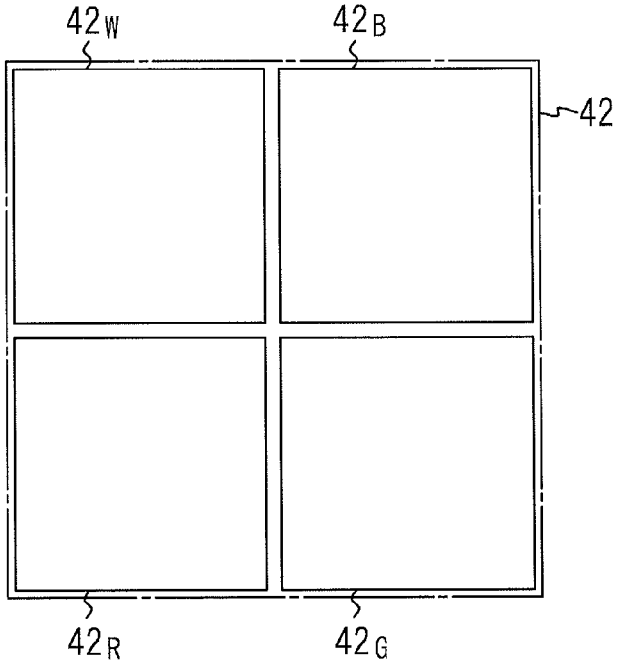
FIG. 3 is a schematic plan view for explaining the brightness in a case where white is displayed at the maximum designed luminance in an image display section adopting a configuration where a pixel is configured of four sub-pixels including a red sub-pixel, a green sub-pixel, a blue sub-pixel, and a white sub-pixel.

FIG. 3 is a schematic plan view for explaining the brightness in a case where white is displayed at the maximum designed luminance in an image display section adopting a configuration where a pixel is configured of four sub-pixels including a red sub-pixel, a green sub-pixel, a blue sub-pixel, and a white sub-pixel.

For convenience of explanation, an area occupied by the red sub-pixel $42_R$, the green sub-pixel $42_G$, the blue sub-pixel $42_B$, and the white sub-pixel $42_W$ is assumed to be about $S_{PX}/4$.

An area occupied by the red sub-pixel $42_R$, the green sub-pixel $42_G$, and the blue sub-pixel $42_B$ in FIG. 3 is about three fourth as much as an area occupied by the red sub-pixel $42_R'$, the green sub-pixel $42_G'$, and the blue sub-pixel $42_B'$ in FIG. 2. Therefore, the brightness of white (brightness of outgoing light) using the additive color mixture of the red sub-pixel $42_R$, the green sub-pixel $42_G$, and the blue sub-pixel $42_B$ becomes about "½"×about "¾", that is, about "⅜".

Further, if it is assumed that when the white sub-pixel $42_W$ reaches the maximum designed luminance, external light in white is wholly reflected, the brightness of white (brightness of outgoing light) in the white sub-pixel $42_W$ becomes about "¼" based on an area occupied by the white sub-pixel provided that the brightness of external light incoming into the pixel 42 is "1".

Accordingly, the pixel brightness in FIG. 3 becomes about "⅜"+about "¼", that is, about "⅝".

As described above, when white is displayed at the maximum designed luminance, the configuration in FIG. 3 allows achieving the higher luminance than the configuration in FIG. 2.

Hereinabove, the improvement of the image luminance in a manner of adding the white sub-pixel $42_W$ has been described.

As stated above, it is possible to enhance the luminance of an image to be displayed by further adding a white sub-pixel to a set of sub-pixels for displaying three primary colors. However, when the white sub-pixel is operated in displaying a color with high purity, such as a color to be displayed through an additive color mixture of any two colors among three primary colors, or a color to be displayed using any one color among three primary colors, the color brightness may deteriorate.

Consequently, in the first embodiment of the present disclosure, four sub-pixels are operated to prevent the color brightness from deteriorating and to allow the luminance of an image to be displayed to be raised. Hereinafter, the detailed description is provided on an operation in the first embodiment of the present disclosure. It is to be noted that the later-described operation is carried out for each signal corresponding to a single pixel.

In the first embodiment of the present disclosure, the signal generating section (signal generator) 20 as a component part of the image display unit 1 operates based on a signal generating program stored in a storage means (not shown in the drawing). The signal generating section (signal generation) 20 determines values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and employs a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

Thus, the signal generating section (signal generator) 20 generates signal for each sub-pixel.

The linearizing and normalizing section 10 generates linearized and input. Among the linearized and normalized signals, the signal for red display, the signal for green display, and the signal for blue display are denoted by reference signs $R_{nL}$, $G_{nL}$, and $B_{nL}$, respectively.

For convenience of explanation, in the first place, the description is provided on generation of the red-display signal $R_{nL}$. Use of Expressions (1) to (3) given below allows generating the signal $R_{nL}$. It is to be noted that a reference sign $R_{temp1}$ in Expressions (1) to (3) is a temporary variable for convenience of calculation.

$$R_{temp1}=R_{sRGB}/255 \tag{1}$$

When $R_{temp1}\leq 0.04045$, the following expression holds.

$$R_{nL}=R_{temp1}/12.92 \tag{2}$$

When $R_{temp1}>0.04045$, the following expression holds.

$$R_{nL}=((R_{temp1}+0.055)/1.055)^{2.4} \tag{3}$$

Also for the green-display signal $G_{nL}$ and the blue-display signal $B_{nL}$ that are linearized and normalized, it is possible to generate those signals on the basis of the similar expressions. For example, as for generation of the signal $G_{nL}$, in Expressions (1) to (3) as referred to above, the reference signs $R_{temp1}$ and $R_{nL}$ may be replaced with reference signs $G_{temp1}$ and $G_{nL}$, respectively. Similarly, for generation of the signal $B_{nL}$, such a replacement may be performed as appropriate.

Next, description is provided on an operation of the signal generating section 20 illustrated in FIG. 1. The signal generating section 20 generates a signal for each sub-pixel based on the linearized and normalized signals ($R_{nL}$, $G_{nL}$, $B_{nL}$) and the like. A red sub-pixel signal, a green sub-pixel signal, and a blue sub-pixel signal are denoted by reference signs $R_{cvt}$, $G_{cvt}$, and $B_{cvt}$, respectively.

First, description is provided on determination of tristimulus values to be output by four sub-pixels using an additive-color-mixture matrix that is determined in consideration of the maximum luminance depending on the color purity.

Figure 4:
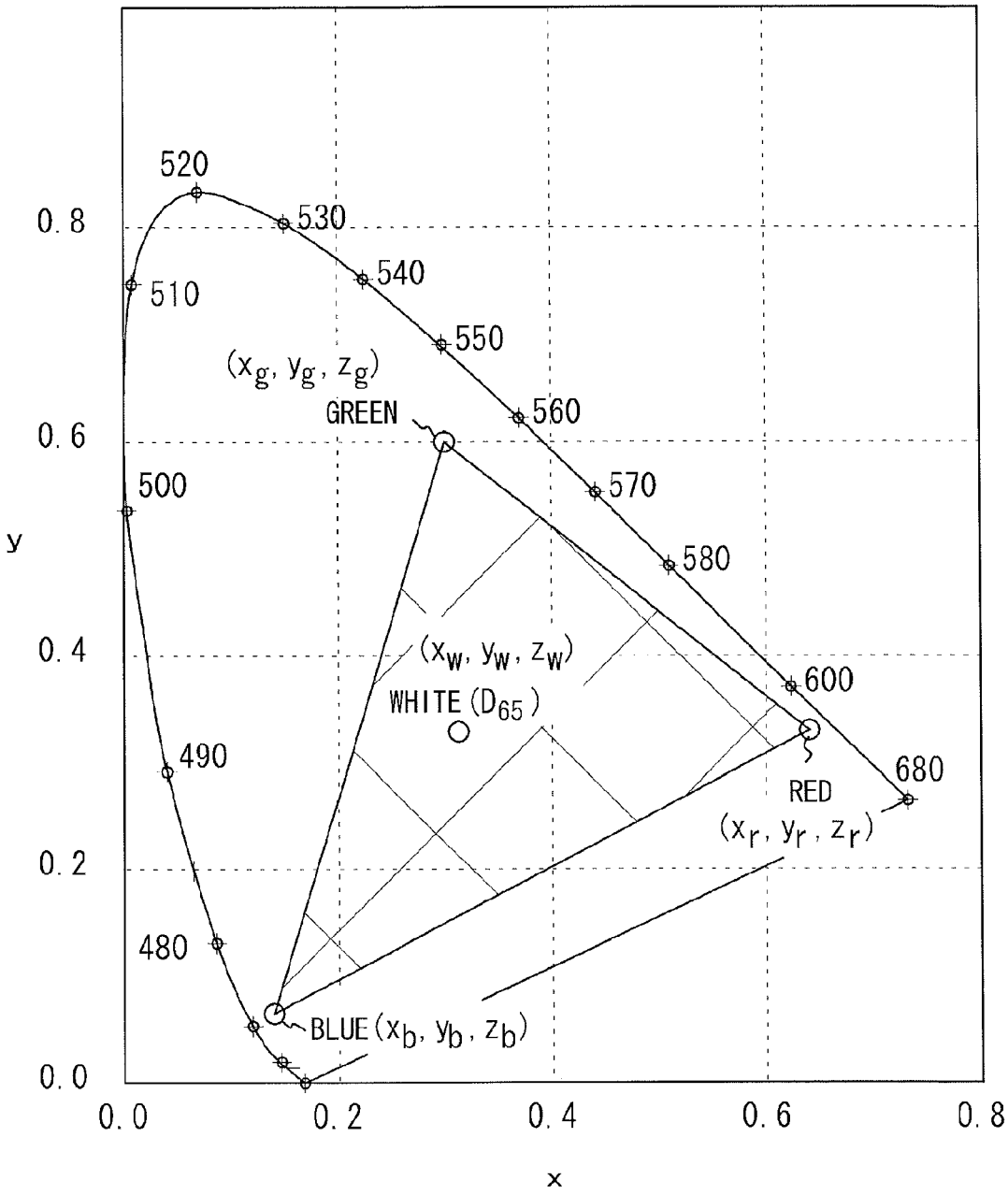
FIG. 4 is a schematic diagram showing a color gamut of sRGB standard in a CIE 1931XYZ color specification system.

Chromaticity coordinates of three primary colors (red, green, and blue) that specify a color gamut and a chromatic coordinate of reference white have predetermined values for each of systems such as NTSC standard and sRGB standard. FIG. 4 shows a color gamut of the sRGB standard in CIE 1931XYZ color specification system.

In this example, the chromaticity coordinates of red, green, blue, and white that are shown in FIG. 4 are represented as in Expressions (4.1) to (4.4).

$$\text{Chromatic coordinate of red}=(x_r,y_r,z_r) \tag{4.1}$$

$$\text{Chromatic coordinate of green}=(x_g,y_g,z_g) \tag{4.2}$$

$$\text{Chromatic coordinate of blue}=(x_b,y_b,z_b) \tag{4.3}$$

$$\text{Chromatic coordinate of white}=(x_w,y_w,z_w) \tag{4.4}$$

Typically, the chromaticity coordinates of display colors in a case where the image display unit exhibits the maximum designed brightness are set to coincide with a value on a chromatic coordinate of white. When the image display unit exhibits the maximum designed brightness, if normalization is performed in such a manner that a coefficient 'Y' of tristimulus values indicating the luminance becomes '1', a relationship represented by Expression (5) given below is established for coefficients ($L_{rmax}$, $L_{gmax}$, $L_{bmax}$) of the maximum luminance for each of red component, green component, and blue component. A matrix denoted by a reference numeral 5A in Expression (5) represents a chromaticity point of white that is normalized with the use of a reference sign $y_w$ shown in the above Expression (4.4), and a matrix denoted by a reference numeral 5B represents tristimulus values of white that are defined in the matrix denoted by a reference numeral 5A. Similarly, a matrix denoted by a reference numeral 5C in Expression (5) represents a matrix composed of chromaticity points of red, green, and blue that are normalized on the basis of above Expressions (4.1) to (4.3).

$$\overset{5A}{\begin{bmatrix} x_w/y_w \\ y_w/y_w \\ z_w/y_w \end{bmatrix}} \equiv \overset{5B}{\begin{bmatrix} X_w \\ 1 \\ Z_w \end{bmatrix}} = \overset{5C}{\begin{bmatrix} x_r/y_r & x_g/y_g & x_b/y_b \\ 1 & 1 & 1 \\ z_r/y_r & z_g/y_g & z_b/y_b \end{bmatrix}} \begin{bmatrix} L_{rmax} \\ L_{gmax} \\ L_{bmax} \end{bmatrix} \tag{5}$$

It is possible to obtain the above-described coefficients ($L_{rmax}$, $L_{gmax}$, $L_{bmax}$) from Expression (6) given below on the basis of Expression (5) mentioned above. A matrix denoted by a reference numeral 6A in Expression (6) is an inverse matrix of the matrix denoted by the reference numeral 5C in Expression (5).

$$\begin{bmatrix} L_{rmax} \\ L_{gmax} \\ L_{bmax} \end{bmatrix} = \overset{6A}{\begin{bmatrix} x_r/y_r & x_g/y_g & x_b/y_b \\ 1 & 1 & 1 \\ z_r/y_r & z_g/y_g & z_b/y_b \end{bmatrix}^{-1}} \begin{bmatrix} x_w/y_w \\ 1 \\ z_w/y_w \end{bmatrix} \tag{6}$$

In a case where the luminance for each color becomes the above-described coefficients ($L_{rmax}$, $L_{gmax}$, $L_{bmax}$), such a case corresponds to a condition that a display signal for each color reaches the maximum value (that is, '1') in a range of a normalized value, and thus Expressions (7.1) and (7.2) given below are established. A matrix denoted by a reference numeral 7B in Expression (7.1) represents the matrix denoted by the reference numeral 5C in Expression (5) described above, and a matrix denoted by a reference numeral 7C is a matrix indicating a luminance ratio of the respective colors at the time of displaying white. Through multiplication of the matrix denoted by the reference numeral 7B by the matrix denoted by the reference numeral 7C, an additive-color-mixture matrix denoted by a reference numeral 7E in Expression (7.2) is obtained. Use of this additive-color-mixture matrix allows obtaining tristimulus values corresponding to the signals ($R_{nL}$, $G_{nL}$, $B_{nL}$). A matrix denoted by a reference numeral 7A in Expression (7.1) represents tristimulus values corresponding to the signals ($R_{nL}$, $G_{nL}$, $B_{nL}$) denoted by a reference numeral 7D.

$$\overset{7A}{\begin{bmatrix} X \\ Y \\ Z \end{bmatrix}} = \overset{7B}{\begin{bmatrix} x_r/y_r & x_g/y_g & x_b/y_b \\ 1 & 1 & 1 \\ z_r/y_r & z_g/y_g & z_b/y_b \end{bmatrix}} \overset{7C}{\begin{bmatrix} L_{rmax} & 0 & 0 \\ 0 & L_{gmax} & 0 \\ 0 & 0 & L_{bmax} \end{bmatrix}} \overset{7D}{\begin{bmatrix} R_{nL} \\ G_{nL} \\ B_{nL} \end{bmatrix}} \tag{7.1}$$

$$= \overset{7E}{\begin{bmatrix} \overline{X}_{rsRGB} & \overline{Y}_{rsRGB} & \overline{Z}_{rsRGB} \\ \overline{X}_{gsRGB} & \overline{Y}_{gsRGB} & \overline{Z}_{gsRGB} \\ \overline{X}_{bsRGB} & \overline{Y}_{bsRGB} & \overline{Z}_{bsRGB} \end{bmatrix}} \begin{bmatrix} R_{nL} \\ G_{nL} \\ B_{nL} \end{bmatrix} \tag{7.2}$$

In this example, a predetermined coefficient 'Purity' representing the color brightness (purity) is defined as shown in Expression (8). A function max ( ) is a function giving a maximum value of arguments, and a function min ( ) is a function giving a minimum value of arguments. The coefficient 'Purity' is equivalent to a coefficient 'S' in a conical model of an HSV color space. As can be seen from Expression (8), a value of the coefficient 'Purity' is determined depending on values of the signals ($R_{nL}$, $G_{nL}$, $B_{nL}$) to be input. Further, the value may be between 0 and 1.

$$\text{Purity} = \max(R_{nL}, G_{nL}, B_{nL}) - \min(R_{nL}, G_{nL}, B_{nL}) \tag{8}$$

The maximum designed white display brightness that is allowed to be displayed by the red sub-pixel $\mathbf{42}_R$, the green sub-pixel $\mathbf{42}_G$, and the blue sub-pixel $\mathbf{42}_B$ in the single pixel 42 is represented by $W_{R+G+B_max}$, and the maximum designed white display brightness that is allowed to be displayed by the white sub-pixel $\mathbf{42}_W$ in the single pixel 42 is represented by $W_{W_max}$. Further, coefficients $TH_1$ and $TH_2$ that are determined by the above values are defined as shown in Expressions (9.1) and (9.2) given below. On this occasion, a relationship represented by Expression (9.3) given below is established between the coefficients $TH_1$ and $TH_2$.

$$TH_1 = \frac{W_{R+G+B_max}}{W_{RG|B_max} + W_{W_max}} \tag{9.1}$$

$$TH_2 = \frac{W_{W_max}}{W_{R-G+B_max} + W_{W_max}} \tag{9.2}$$

$$TH_1 + TH_2 = 1 \tag{9.3}$$

In an example illustrated in FIG. 3, $TH_1$ and $TH_2$ may take values of [0.6] and [0.4], respectively.

Figure 5:
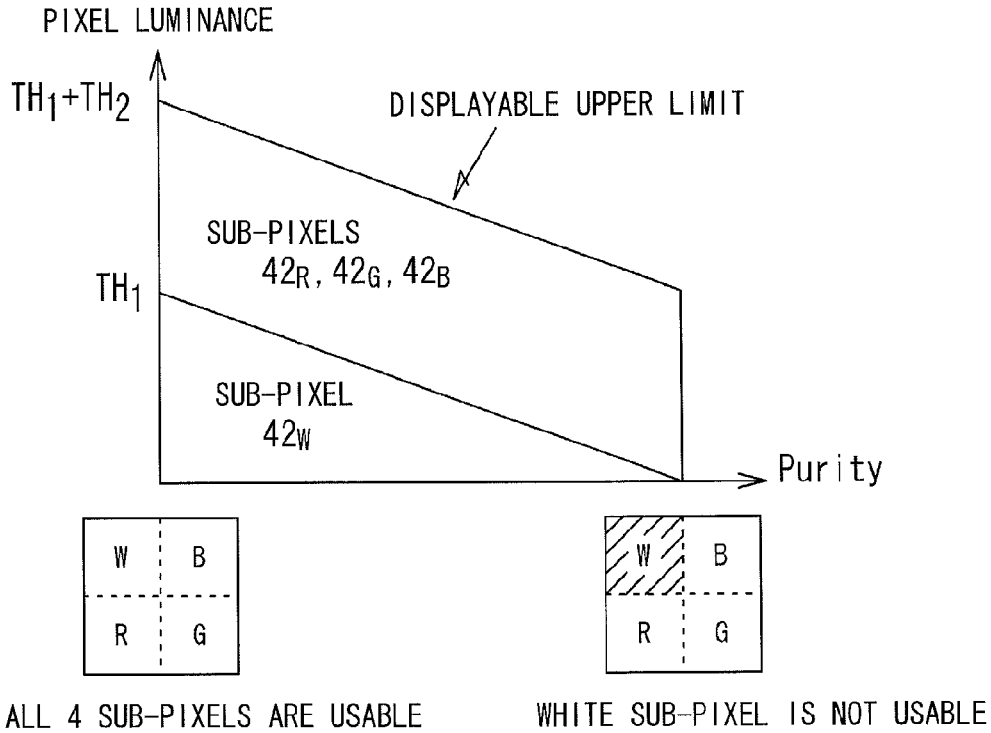
FIG. 5 is a schematic graph showing a relationship between a coefficient 'Purity' and an upper limit allowable for a pixel to display.

The white sub-pixel displays white. Therefore, when the white sub-pixel is operated in displaying any color with high purity, such as a color to be displayed through an additive color mixture of any two colors among three primary colors, or a color to be displayed using any one color among three primary colors, the color brightness may deteriorate. Consequently, to satisfy the requirements for prevention of deterioration in the purity of color in an image to be displayed, etc., it may be difficult to use the white sub-pixel for displaying any color with high purity. In this case, when coefficients of the maximum designed luminance are denoted by ($L_{rRGBmax}$, $L_{gRGBmax}$, $L_{bRGBmax}$), it is possible to represent these coefficients as in Expression (10.1) given below. On the other hand, when white is displayed, even use of the white sub-pixel may have no influence. In such a case, when coefficients of the maximum designed luminance are denoted by ($L_{rRGBWmax}$, $L_{gRGBWmax}$, $L_{bRGBWmax}$), it is possible to represent these coefficients as in Expression (10.2) given below. Further, FIG. 5 shows a relationship between the coefficient 'Purity' and an upper limit allowable for a pixel to display.

$$\begin{bmatrix} L_{rRGBmax} \\ L_{gRGBmax} \\ L_{bRGBmax} \end{bmatrix} = TH_1 \begin{bmatrix} L_{rmax} \\ L_{gmax} \\ L_{bmax} \end{bmatrix} \tag{10.1}$$

$$\begin{bmatrix} L_{rRGBWmax} \\ L_{gRGBWmax} \\ L_{bRGBWmax} \end{bmatrix} = (TH_1 + TH_2) \begin{bmatrix} L_{rmax} \\ L_{gmax} \\ L_{bmax} \end{bmatrix} = \begin{bmatrix} L_{rmax} \\ L_{gmax} \\ L_{bmax} \end{bmatrix} \tag{10.2}$$

With attention paid to a relationship represented by Expressions (10.1) and (10.2), a predetermined purity coefficient 'Ψ' is defined as shown in Expression (11) given below. A value of the purity coefficient 'Ψ' varies to approach the coefficient $TH_1$ with an increase in a value of the coefficient 'Purity' and varies to approach 1 with a decrease in a value of the coefficient 'Purity'.

$$\Psi = (TH_1 - 1) \times \text{Purity} + 1 \tag{11}$$

It is possible to derive possible coefficient values of the maximum luminance depending on the color purity by multiplying the coefficients ($L_{rmax}$, $L_{gmax}$, $L_{bmax}$) by the purity coefficient Ψ. Further, use of a new additive-color-mixture matrix that is obtained using the possible coefficient values of the maximum luminance depending on the color purity allows to determine tristimulus values to be output by four sub-pixels. In other words, it is possible to determine the tristimulus values to be output by four sub-pixels through multiplying a product of the additive-color-mixture matrix and the matrix of the signals ($R_{nL}$, $G_{nL}$, $B_{nL}$) by the purity coefficient 'Ψ'.

In concrete terms, the tristimulus values ($X_{RGBW}$, $Y_{RGBW}$, $Z_{RGBW}$) to be output by four sub-pixels are determined from Expression (12.3) or (12.4) as represented below on the basis of Expression (12.1) given below. In Expression (12.1), a matrix denoted by a reference numeral 12A is the tristimulus values to be output by four sub-pixels, a matrix denoted by a reference numeral 12B is the matrix denoted by the reference numeral 5C in the above-described Expression (5), and a matrix denoted by a reference numeral 12C is a matrix composed of the possible coefficient values of the maximum luminance depending on the color purity. Further, a matrix denoted by a reference numeral 12D in Expression (12.2) is the matrix denoted by the reference numeral 7C in Expression (7.1), a matrix denoted by a reference numeral 12E in Expression (12.3) is the additive-color-mixture matrix denoted by the reference numeral 7E in Expression (7.2), and a matrix denoted by a reference numeral 12F in Expression (12.3) is a matrix derived through multiplying each component of the additive-color-mixture matrix by the purity coefficient 'Ψ'.

$$\begin{bmatrix} X_{RGBW} \\ Y_{RGBW} \\ Z_{RGBW} \end{bmatrix} = \overset{12A}{\begin{bmatrix} x_r/y_r & x_g/y_g & x_b/y_b \\ 1 & 1 & 1 \\ z_r/y_r & z_g/y_g & z_b/y_b \end{bmatrix}} \overset{12B}{\begin{bmatrix} \psi L_{rmax} & 0 & 0 \\ 0 & \psi L_{gmax} & 0 \\ 0 & 0 & \psi L_{bmax} \end{bmatrix}} \overset{12C}{\begin{bmatrix} R_{nL} \\ G_{nL} \\ B_{nL} \end{bmatrix}} \tag{12.1}$$

$$= \psi \overset{12D}{\begin{bmatrix} x_r/y_r & x_g/y_g & x_b/y_b \\ 1 & 1 & 1 \\ z_r/y_r & z_g/y_g & z_b/y_b \end{bmatrix} \begin{bmatrix} L_{rmax} & 0 & 0 \\ 0 & L_{gmax} & 0 \\ 0 & 0 & L_{bmax} \end{bmatrix}} \begin{bmatrix} R_{nL} \\ G_{nL} \\ B_{nL} \end{bmatrix} \tag{12.2}$$

$$= \psi \overset{12E}{\begin{bmatrix} \overline{X}_{rsRGB} & \overline{Y}_{rsRGB} & \overline{Z}_{rsRGB} \\ \overline{X}_{gsRGB} & \overline{Y}_{gsRGB} & \overline{Z}_{gsRGB} \\ \overline{X}_{bsRGB} & \overline{Y}_{bsRGB} & \overline{Z}_{bsRGB} \end{bmatrix}} \begin{bmatrix} R_{nL} \\ G_{nL} \\ B_{nL} \end{bmatrix} \tag{12.3}$$

$$= \overset{12F}{\begin{bmatrix} \overline{X}_{rRGBW} & \overline{Y}_{rRGBW} & \overline{Z}_{rRGBW} \\ \overline{X}_{gRGBW} & \overline{Y}_{gRGBW} & \overline{Z}_{gRGBW} \\ \overline{X}_{bRGBW} & \overline{Y}_{bRGBW} & \overline{Z}_{bRGBW} \end{bmatrix}} \begin{bmatrix} R_{nL} \\ G_{nL} \\ B_{nL} \end{bmatrix} \tag{12.4}$$

Hereinabove, the description on determination of the tristimulus values to be output by four sub-pixels using the additive-color-mixture matrix that is determined in consideration of the maximum luminance depending on the color purity has been given. Next, description is provided on an operation to generate the signals ($R_{cvt}$, $G_{cvt}$, $B_{cvt}$, $W_{cvt}$) on the basis of the signals ($R_{nL}$, $G_{nL}$, $B_{nL}$). As described previously, the signal generating section determines values of the signals ($R_{cvt}$, $G_{cvt}$, $B_{cvt}$) based on a first matrix and a second matrix, and employs a value of the white sub-pixel signal $W_{cvt}$ as the value of min ($R_{nL}$, $G_{nL}$, $B_{nL}$). The first matrix is configured of a difference obtained through subtracting first tristimulus values from second tristimulus values. The first tristimulus values is a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_L$), and the second tristimulus values is obtained through multiplying the purity coefficient 'Ψ' by the product of the additive-color-mixture matrix and the matrix of the signals ($R_{nL}$, $G_{nL}$, $B_{nL}$). The second matrix is an inverse matrix of a matrix obtained through multiplying the additive-color-mixture matrix by '$TH_1$'.

Figure 6:
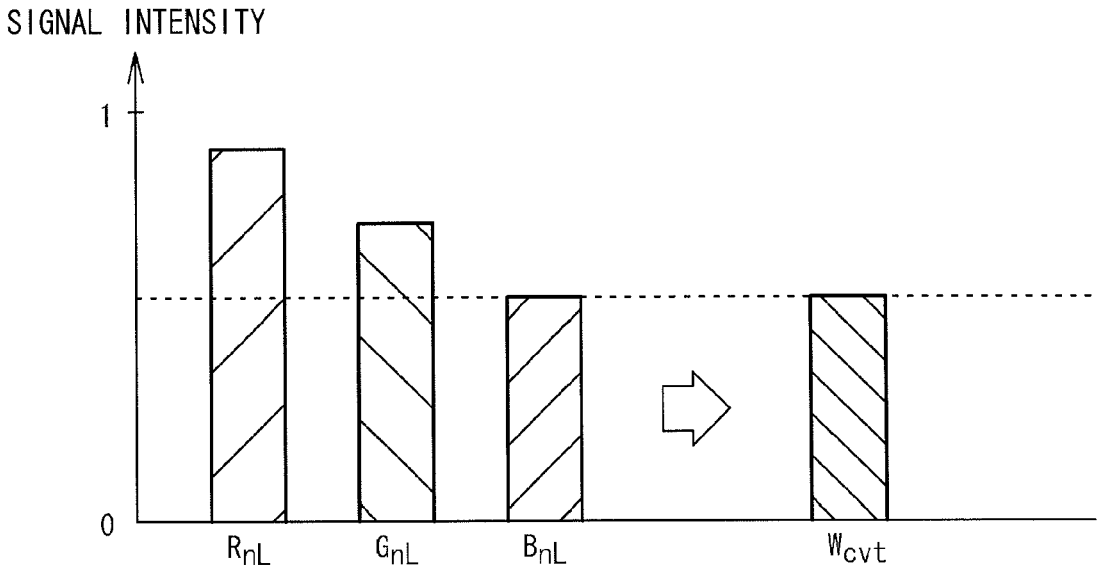
FIG. 6 is a schematic graph for explaining that a minimum value of normalized image signals is set to be a value of an image signal for a white sub-pixel.

First, a value of the signal $W_{cvt}$ is determined on the basis of Expression (13) given below. More specifically, as shown in an example in FIG. 6, a value of the signal $W_{cvt}$ is allowed to be a minimum value of the signals ($R_{nL}$, $G_{nL}$, $B_{nL}$).

$$W_{cvt} = \min(R_{nL}, G_{nL}, B_{nL}) \tag{13}$$

Next, on the basis of Expression (14) given below, a calculation is made for the tristimulus values that is a product of the additive-color-mixture matrix and the matrix of the signals ($R_{nL}$, $G_{nL}$, $B_{nL}$) when all the values of the signals ($R_{nL}$, $G_{nL}$, and $B_{nL}$) are min ($R_{nL}$, $G_{nL}$, $B_{nL}$). In other words, the tristimulus values ($X_W$, $Y_W$, $Z_W$) to be output by the signals ($W_{cvt}$, $W_{cvt}$, $W_{cvt}$) are calculated.

$$\begin{bmatrix} X_W \\ Y_W \\ Z_W \end{bmatrix} = \begin{bmatrix} \overline{X}_{rsRGB} & \overline{Y}_{rsRGB} & \overline{Z}_{rsRGB} \\ \overline{X}_{gsRGB} & \overline{Y}_{gsRGB} & \overline{Z}_{gsRGB} \\ \overline{X}_{bsRGB} & \overline{Y}_{bsRGB} & \overline{Z}_{bsRGB} \end{bmatrix} \begin{bmatrix} W_{cvt} \\ W_{cvt} \\ W_{cvt} \end{bmatrix} \tag{14}$$

Subsequently, as shown in Expression (15) given below, the tristimulus values ($X_{RGB}$, $Y_{RGB}$, $Z_{RGB}$) to be output by the red sub-pixel, the green sub-pixel, and the blue sub-pixel are determined through subtracting the tristimulus values to be output by the signals ($W_{cvt}$, $W_{cvt}$, $W_{cvt}$) from the tristimulus values ($X_{RGBW}$, $Y_{RGBW}$, $Z_{RGBW}$) that are denoted by the reference numeral 12A in Expression (12.1).

$$\begin{bmatrix} X_{RGB} \\ Y_{RGB} \\ Z_{RGB} \end{bmatrix} = \begin{bmatrix} X_{RGBW} \\ Y_{RGBW} \\ Z_{RGBW} \end{bmatrix} - \begin{bmatrix} X_W \\ Y_W \\ Z_W \end{bmatrix} \tag{15}$$

Relations represented in Expressions (16.1) to (16.4) given below are established between the tristimulus values ($X_{RGB}$, $Y_{RGB}$, $Z_{RGB}$) and the signals ($R_{cvt}$, $G_{cvt}$, $B_{cvt}$) that generate such tristimulus values. In Expression (16.1), a matrix denoted by a reference numeral 16A is the matrix denoted by the reference numeral 5C in Expression (5), and a matrix denoted by a reference numeral 16B is a matrix composed of the coefficients ($L_{rRGBmax}$, $L_{gRGBmax}$, $L_{bRGBmax}$) that are shown in Expression (10.1). A matrix denoted by a reference numeral 16C in Expression (16.2) is the matrix denoted with the reference numeral 7C in Expression (7.1). A matrix denoted by a reference numeral 16D in Expression (16.3) is the additive-color-mixture matrix denoted by the reference numeral 7E in Expression (7.2), and a matrix denoted by a reference numeral 16F in Expression (16.4) is a matrix derived through multiplying each element of the additive-color-mixture matrix by the coefficient $TH_1$.

$$\begin{bmatrix} X_{RGB} \\ Y_{RGB} \\ Z_{RGB} \end{bmatrix} = \overset{16A}{\begin{bmatrix} x_r/y_r & x_g/y_g & x_b/y_b \\ 1 & 1 & 1 \\ z_r/y_r & z_g/y_g & z_b/y_b \end{bmatrix}} \overset{16B}{\begin{bmatrix} L_{rRGBmax} & 0 & 0 \\ 0 & L_{gRGBmax} & 0 \\ 0 & 0 & L_{bRGBmax} \end{bmatrix}} \begin{bmatrix} R_{cvt} \\ G_{cvt} \\ B_{cvt} \end{bmatrix} \tag{16.1}$$

$$= TH_1 \begin{bmatrix} x_r/y_r & x_g/y_g & x_b/y_b \\ 1 & 1 & 1 \\ z_r/y_r & z_g/y_g & z_b/y_b \end{bmatrix} \overset{16C}{\begin{bmatrix} L_{rmax} & 0 & 0 \\ 0 & L_{gmax} & 0 \\ 0 & 0 & L_{bmax} \end{bmatrix}} \begin{bmatrix} R_{cvt} \\ G_{cvt} \\ B_{cvt} \end{bmatrix} \tag{16.2}$$

$$= TH_1 \overset{16D}{\begin{bmatrix} \overline{X}_{rsRGB} & \overline{Y}_{rsRGB} & \overline{Z}_{rsRGB} \\ \overline{X}_{gsRGB} & \overline{Y}_{gsRGB} & \overline{Z}_{gsRGB} \\ \overline{X}_{bsRGB} & \overline{Y}_{bsRGB} & \overline{Z}_{bsRGB} \end{bmatrix}} \begin{bmatrix} R_{cvt} \\ G_{cvt} \\ B_{cvt} \end{bmatrix} \tag{16.3}$$

$$= \overset{16E}{\begin{bmatrix} \overline{X}_{rRGB} & \overline{Y}_{rRGB} & \overline{Z}_{rRGB} \\ \overline{X}_{gRGB} & \overline{Y}_{gRGB} & \overline{Z}_{gRGB} \\ \overline{X}_{bRGB} & \overline{Y}_{bRGB} & \overline{Z}_{bRGB} \end{bmatrix}} \begin{bmatrix} R_{cvt} \\ G_{cvt} \\ B_{cvt} \end{bmatrix} \tag{16.4}$$

Therefore, it is possible to obtain the signals ($R_{cvt}$, $G_{cvt}$, $B_{cvt}$) as shown in Expression (17.1) given below on the basis of Expression (16.3). Alternatively, the signals ($R_{cvt}$, $G_{cvt}$, $B_{cvt}$) are allowed to be obtained as shown in Expression (17.2) given below on the basis of Expression (16.4). A matrix denoted by a reference numeral 17A in Expression (17.1) is an inverse matrix of the additive-color-mixture matrix denoted by the reference numeral 7E in Expression (7.2). Further, a matrix denoted by a reference numeral 17B in Expression (17.2) is an inverse matrix of the matrix denoted by the reference numeral 16E in Expression (16.3), in other words, an inverse matrix of a matrix derived through multiplying the additive-color-mixture matrix by the coefficient $TH_1$.

$$\begin{bmatrix} R_{cvt} \\ G_{cvt} \\ B_{cvt} \end{bmatrix} = \frac{1}{TH_1} \overset{17A}{\begin{bmatrix} \overline{X}_{rsRGB} & \overline{Y}_{rsRGB} & \overline{Z}_{rsRGB} \\ \overline{X}_{gsRGB} & \overline{Y}_{gsRGB} & \overline{Z}_{gsRGB} \\ \overline{X}_{bsRGB} & \overline{Y}_{bsRGB} & \overline{Z}_{bsRGB} \end{bmatrix}^{-1}} \begin{bmatrix} X_{RGB} \\ Y_{RGB} \\ Z_{RGB} \end{bmatrix} \tag{17.1}$$

$$= \overset{17B}{\begin{bmatrix} \overline{X}_{rRGB} & \overline{Y}_{rRGB} & \overline{Z}_{rRGB} \\ \overline{X}_{gRGB} & \overline{Y}_{gRGB} & \overline{Z}_{gRGB} \\ \overline{X}_{bRGB} & \overline{Y}_{bRGB} & \overline{Z}_{bRGB} \end{bmatrix}^{-1}} \begin{bmatrix} X_{RGB} \\ Y_{RGB} \\ Z_{RGB} \end{bmatrix} \tag{17.2}$$

By using Expression (13) and Expression (17.1) or (17.2) as described above, it is possible to obtain the signals ($R_{cvt}$, $G_{cvt}$, $B_{cvt}$, $W_{cvt}$)

Hereinabove, the description on the operation of the signal generating section 20 has been given.

The generated signals $W_{cvt}$, $R_{cvt}$, $G_{cvt}$, and $B_{cvt}$ are input to a nonlinearlizing and quantizing section 30, and then are output as digital signals in conformity with the sRGB standard. Among the digitized signals, a signal for the red sub-pixel, a signal for the green sub-pixel, a signal for the blue sub-pixel, and a signal for the white sub-pixel are denoted by reference signs $R_{out}$, $G_{out}$, $B_{out}$, and $W_{out}$, respectively.

For convenience of explanation, in the first place, the description is provided on the signal $R_{out}$ for the red sub-pixel. It is possible to generate the signal $R_{out}$ on the basis of Expressions (18) to (20) given below. It is to be noted that a reference sign $R_{temp2}$ in Expressions (18) to (20) is a temporary variable for convenience of calculation. Further, a function 'round' in Expression (20) is a function for rounding off a number with a decimal point to the nearest whole number. When $R_{cvt} \leq 0.0031308$, the following expression holds.

$$R_{temp2} = 12.02 \times R_{cvt} \tag{18}$$

When $R_{cvt} > 0.0031308$, the following expression holds.

$$R_{temp2} = 1.055 \times R_{cvt}^{1/2.4} - 0.055 \tag{19}$$

$$R_{out} = \mathrm{round}(255 \times R_{temp2}) \tag{20}$$

Also for the signal $G_{out}$ for the green sub-pixel, the signal $B_{out}$ for the blue sub-pixel, and the signal $W_{out}$ for the white sub-pixel, it is possible to generate these signals on the basis of the similar expressions. For example, for generation of the signal $G_{out}$, in Expressions (18) to (20) described above, the reference signs $R_{temp2}$, $R_{cvt}$, and $R_{out}$ may be replaced with reference signs $G_{temp1}$, $G_{cvt}$, and $G_{out}$, respectively. For generation of the signals $B_{out}$ and $W_{out}$ as well, the same replacement as above may be performed.

The image display section 40 operates based on the signal $R_{out}$ for the red sub-pixel, the signal $G_{out}$ for the green sub-pixel, the signal $B_{out}$ for the blue sub-pixel, and the signal $W_{out}$ for the white sub-pixel, thereby displaying images.

The operation of the first embodiment of the present disclosure has been described thus far. Next, for the sake of easier understanding, description is provided on advantageous effects to be achieved by the first embodiment of the present disclosure by contrast with operations in reference examples.

For example, a reference example may be supposed where each of minimum values of the signals ($R_{nL}$, $G_{nL}$, $B_{nL}$) is a value of the signal $W_{cvt}$, and the signals ($R_{cvt}$, $G_{cvt}$, $B_{cvt}$) are derived by subtracting the $W_{cvt}$ from the signals ($R_{nL}$, $G_{nL}$, $B_{nL}$), respectively. In concrete terms, a processing shown in Expressions (21) to (24) given below is carried out.

$$W_{cvt} = \min(R_{nL}, G_{nL}, B_{nL}) \tag{21}$$

$$R_{cvt} = R_{nL} - W_{cvt} \tag{22}$$

$$G_{cvt}=G_{nL}-W_{cvt} \quad (23)$$

$$B_{cvt}=B_{nL}-W_{cvt} \quad (24)$$

In this method, however, when all of the signals ($R_{nL}$, $G_{nL}$, $B_{nL}$) are [1], the signal $W_{cvt}$ becomes 1, and the signals ($R_{nL}$, $G_{nL}$, $B_{nL}$) become 0. Therefore, unlike the first embodiment of the present disclosure, it may be difficult to improve the image luminance by adding the white sub-pixel.

Further, for example, a reference example may be supposed where each of minimum values of the signals ($R_{nL}$, $G_{nL}$, $B_{nL}$) is a value of the signal $W_{cvt}$, and the Signals ($R_{nL}$, $G_{nL}$, $B_{nL}$) are used as they are for the signals ($R_{cvt}$, $G_{cvt}$, $B_{cvt}$), respectively. In concrete terms, a processing shown in Expressions (25) to (28) given below is carried out.

$$W_{cvt}=\min(R_{nL},G_{nL},B_{nL}) \quad (25)$$

$$R_{cvt}=R_{nL} \quad (26)$$

$$G_{cvt}=G_{nL} \quad (27)$$

$$B_{cvt}=B_{nL} \quad (28)$$

In this method, however, when the signals ($R_{nL}$, $G_{nL}$, $B_{nL}$) are varied to keep minimum values or maximum values thereof constant, a deviance between the chromaticity calculated from the signals ($R_{nL}$, $G_{nL}$, $B_{nL}$) and that calculated from the signals ($R_{cvt}$, $G_{cvt}$, $B_{cvt}$, $W_{cvt}$) may become larger as compared with the first embodiment of the present disclosure.

Additionally, for example, when an average value of the signals ($R_{nL}$, $G_{nL}$, $B_{nL}$) is represented by $AveRGB_{nL}$, a reference example may be supposed where such an average value is a value of the signal $W_{cvt}$, and the signals ($R_{nL}$, $G_{nL}$, $B_{nL}$) are used as they are for the signals ($R_{cvt}$, $G_{cvt}$, $B_{cvt}$), respectively. In concrete terms, a processing shown in Expressions (29) to (32) given below is carried out.

$$W_{cvt}=\mathrm{Ave}RGB_{nL} \quad (29)$$

$$R_{cvt}=R_{nL} \quad (30)$$

$$G_{cvt}=G_{nL} \quad (31)$$

$$B_{cvt}=B_{nL} \quad (32)$$

In this method, however, with an increase in a difference between the maximum values and the minimum vales of the signals ($R_{nL}$, $G_{nL}$, $B_{nL}$), a deviance between the chromaticity calculated from the signals ($R_{nL}$, $G_{nL}$, $B_{nL}$) and that calculated from the signals ($R_{cvt}$, $G_{cvt}$, $B_{cvt}$, $W_{cvt}$) may become larger as compared with the first embodiment of the present disclosure.

The embodiments of the present disclosure are described in concrete terms thus far, although the present technology is not limited to the above-described embodiments, and different variations based on the technical idea of the present disclosure are available.

It is to be noted that the present technology may be configured as follows.

(1) An image display unit, including:

an image display section having pixels arranged two-dimensionally in a matrix pattern, the pixels each including a red sub-pixel, a green sub-pixel, a blue sub-pixel, and a white sub-pixel; and a signal generating section configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generating section being configured to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and being configured to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

(2) The image display unit according to (1), wherein the purity coefficient 'Ψ' is defined by following expression.

$$\Psi=(TH_1-1)\times\mathrm{Purity}+1$$

(3) The image display unit according to (1) or (2), wherein the image display section is of a reflective type.

(4) The image display unit according to (1) or (2), wherein the image display section is of a transmissive type.

(5) A method of driving an image display unit with an image display section and a signal generating section, the image display section having pixels arranged two-dimensionally in a matrix pattern, the pixels each including a red sub-pixel, a green sub-pixel, a blue sub-pixel, and a white sub-pixel, and the signal generating section being configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the method including:

allowing the signal generating section to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and allowing the signal generating section to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix sed of the signals ($R_{nL}$, $G_{nL}$, $B_{nL}$) resulting in a three-rows-one-column matrix composed of tristimulus values, the purity coefficient having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

(6) The method according to (5), wherein the purity coefficient is defined by following expression.

$$\Psi=(TH1-1)\times\text{Purity}+1$$

(7) The method according to (5) or (6), wherein the image display section is of a reflective type.

(8) The method according to (5) or (6), wherein the image display section is of a transmissive type.

(9) A non-transitory tangible recording medium having a computer-readable program embodied therein, the computer-readable program allowing, when executed by an signal generator, the signal generator to perform data processing, the signal generator being configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the data processing including:

allowing the signal generator to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and allowing the signal generator to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

(10) The non-transitory tangible recording medium having the computer-readable program embodied therein according to (9), wherein the purity coefficient 'Ψ' is defined by following expression.

$$\Psi=(TH1-1)\times\text{Purity}+1$$

(11) A signal generator including a signal generating section configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generating section being configured to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient and being configured to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

(12) The signal generator according to (11), wherein the purity coefficient 'Ψ' is defined by following expression.

$$\Psi=(TH1-1)\times\text{Purity}+1$$

(13) A signal generation method generating a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generation method including:

determining values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ'; and employing a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

(14) The signal generation method according to (13), wherein the purity coefficient 'Ψ' is defined by following expression.

$$\Psi=(TH1-1)\times\text{Purity}+1$$

It should be understood by those skilled in the art that various modifications, combinations, sub-combinations and alterations may occur depending on design requirements and other factors insofar as they are within the scope of the appended claims or the equivalents thereof.

What is claimed is:

1. An image display unit, comprising:

an image display section having pixels arranged two-dimensionally in a matrix pattern, the pixels each including a red sub-pixel, a green sub-pixel, a blue sub-pixel, and a white sub-pixel; and a signal generating section configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generating section being configured to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and being configured to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

2. The image display unit according to claim 1, wherein the purity coefficient 'Ψ' is defined by following expression $$\Psi=(TH_1-1)\times\text{Purity}+1.$$

3. The image display unit according to claim 1, wherein the image display section is of a reflective type.

4. The image display unit according to claim 1, wherein the image display section is of a transmissive type.

5. A method of driving an image display unit with an image display section and a signal generating section, the image display section having pixels arranged two-dimensionally in a matrix pattern, the pixels each including a red sub-pixel, a green sub-pixel, a blue sub-pixel, and a white sub-pixel, and the signal generating section being configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the method comprising:

allowing the signal generating section to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and allowing the signal generating section to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix sed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

6. A non-transitory tangible recording medium having a computer-readable program embodied therein, the computer-readable program allowing, when executed by an signal generator, the signal generator to perform data processing, the signal generator being configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the data processing comprising:

allowing the signal generator to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and allowing the signal generator to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

7. A signal generator comprising a signal generating section configured to generate a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generating section being configured to determine values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ', and being configured to employ a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

8. A signal generation method generating a red sub-pixel signal, a green sub-pixel signal, a blue sub-pixel signal, and a white sub-pixel signal, based on a red-display image signal, a green-display image signal, and a blue-display image signal that are provided in accordance with an image to be displayed, the signal generation method comprising:

determining values of the red sub-pixel signal $R_{cvt}$, the green sub-pixel signal $G_{cvt}$, and the blue sub-pixel signal $B_{cvt}$, based on a first matrix and a second matrix, with use of a coefficient 'Purity', an additive-color-mixture matrix, and a purity coefficient 'Ψ'; and employing a value of the white sub-pixel signal $W_{cvt}$ as a value of min ($R_{nL}$, $G_{nL}$, $B_{nL}$), where the min ($R_{nL}$, $G_{nL}$, $B_{nL}$) represents a minimum value of the red-display image signal $R_{nL}$, the green-display image signal $G_{nL}$, and the blue-display image signal $B_{nL}$ that are linearized and normalized and are provided for each of the pixels, the coefficient 'Purity' being defined by a value obtained through subtracting the min ($R_{nL}$, $G_{nL}$, $B_{nL}$) from max ($R_{nL}$, $G_{nL}$, $B_{nL}$), where the max ($R_{nL}$, $G_{nL}$, $B_{nL}$) represents a maximum value of the red-display image signal $R_{nL}$, the green-display image signal $G_{nL}$, and the blue-display image signal $B_{nL}$, the additive-color-mixture matrix being defined in accordance with specification of the image to be displayed, a product of the additive-color-mixture matrix and a three-rows-one-column matrix composed of the signals ($R_{nL}$, $G_{nL}$, $B_{nL}$) resulting in a three-rows-one-column matrix composed of tristimulus values, the purity coefficient 'Ψ' having a value that varies to approach a value '$TH_1$' with an increase in a value of the coefficient 'Purity' and varies to approach a value '1' with a decrease in the value of the coefficient 'Purity', the value '$TH_1$' representing a ratio given by an expression of $W_{R+G+B_max}/(W_{R+G+B_max}+W_{W_max})$, where the parameter '$W_{R+G+B_max}$' represents designed maximum white luminance that is realized with the red sub-pixel, the green sub-pixel, and the blue sub-pixel in a pixel of the pixels, and the parameter '$W_{W_max}$' represents designed maximum white luminance that is realized with the white sub-pixel in the pixel of the pixels, the first matrix being configured of a difference obtained through subtracting first tristimulus values from second tristimulus values, the first tristimulus values being a product of the additive-color-mixture matrix and the matrix of the signals ($R_{nL}$, $G_{nL}$, $B_{nL}$) when all of the values of the signals ($R_{nL}$, $G_{nL}$, $B_{nL}$) are min ($R_{nL}$, $G_{nL}$, $B_{nL}$), and the second tristimulus values being obtained through multiplying the purity coefficient 'Ψ' by the product of the additive-color-mixture matrix and the matrix of the signals ($R_{nL}$, $G_{nL}$, $B_{nL}$), and the second matrix being an inverse matrix of a matrix obtained through multiplying the additive-color-mixture matrix by '$TH_1$'.

* * * * *